US009332351B2

(12) United States Patent
Porter et al.

(10) Patent No.: US 9,332,351 B2
(45) Date of Patent: May 3, 2016

(54) LONG-THROW ACOUSTIC TRANSDUCER

(71) Applicant: Apple Inc., Cupertino, CA (US)

(72) Inventors: Scott P. Porter, Cupertino, CA (US); Christopher Wilk, Los Gatos, CA (US); Ruchir M. Dave, San Jose, CA (US)

(73) Assignee: Apple Inc., Cupertino, CA (US)

( * ) Notice: Subject to any disclaimer, the term of this patent is extended or adjusted under 35 U.S.C. 154(b) by 327 days.

(21) Appl. No.: 13/764,682

(22) Filed: Feb. 11, 2013

(65) Prior Publication Data

US 2014/0226849 A1 Aug. 14, 2014

(51) Int. Cl.

| | |
|---|---|
| ***H04R 1/00*** | (2006.01) |
| ***H04R 9/02*** | (2006.01) |
| *H04R 9/06* | (2006.01) |
| *H04R 11/02* | (2006.01) |

(52) U.S. Cl.

CPC ..... *H04R 9/025* (2013.01); *H04R 9/06* (2013.01); *H04R 9/066* (2013.01); *H04R 11/02* (2013.01); *H04R 2209/022* (2013.01); *H04R 2209/041* (2013.01); *H04R 2400/03* (2013.01)

(58) Field of Classification Search

CPC ..... H04R 9/025; H04R 2209/022; H04R 2400/03; H04R 2240/07; H04R 2240/00; H04R 9/06; H04R 2209/041; H04R 9/066; H04R 11/02

USPC ..... 381/412, 340, 396

See application file for complete search history.

(56) References Cited

U.S. PATENT DOCUMENTS

| | | | | |
|---|---|---|---|---|
| 4,852,177 | A * | 7/1989 | Ambrose | H04R 1/1016 181/135 |
| 5,624,376 | A | 4/1997 | Ball et al. | |
| 6,217,508 | B1 | 4/2001 | Ball et al. | |
| 6,735,318 | B2 | 5/2004 | Cho | |
| 6,838,963 | B2 | 1/2005 | Zimmerling et al. | |
| 2006/0204029 | A1 * | 9/2006 | Mori | H04R 9/066 381/423 |
| 2008/0075319 | A1 * | 3/2008 | Kantor | H04R 9/025 381/420 |
| 2009/0141926 | A1 | 6/2009 | Clair et al. | |
| 2011/0169291 | A1 * | 7/2011 | Siethorst et al. | 296/37.8 |

FOREIGN PATENT DOCUMENTS

WO 0055482 A1 9/2000

OTHER PUBLICATIONS

IEEE Transaction on Magnetics, Application of ferrofluids as an acoustic transducer material, Mar. 1980, pp. 372-374.

Marston, Timothy, Infrasonic Pistonphone Calibration, The Pennsylvania State University, 2009.

Kantor, Kenneth, et al., Compact Magnetic Suspension Transducer, Audio Engineering Society, AES 117th Convention, 2004.

* cited by examiner

*Primary Examiner* — Davetta W Goins
*Assistant Examiner* — Oyesola C Ojo
(74) *Attorney, Agent, or Firm* — Blakely, Sokoloff, Taylor & Zafman LLP

(57) ABSTRACT

An acoustic transducer includes a housing, which may be a circular cylinder or may have a rectangular cross-section. Two permanent magnets that closely fit the inside of the housing are joined by a linkage having a high magnetic permeability to form a piston that is inserted into the housing. Two pole coils surround the housing with each coil adjacent one of the permanent magnets. The coils are arranged to cause the piston to oscillate within the housing and emit sound waves when coupled to an electrical signal. One end of the housing may be closed except for a barometric leak. A third permanent magnet or a spring may provide a restoring force that centers the piston between the coils when the piston is not subjected to other forces. One of the permanent magnets on the piston may include a vent passage.

31 Claims, 3 Drawing Sheets

LONG-THROW ACOUSTIC TRANSDUCER

BACKGROUND

1. Field

Embodiments of the invention relate to the field of audio speakers; and more specifically, to an audio speaker that uses a moving magnetic piston as the sound producing element.

2. Background

Audio speakers use electrical signals to produce air pressure waves which are perceived as sounds. Many audio speakers use a diaphragm that is movably suspended in a frame. The diaphragm is coupled to a voice coil that is suspended in a magnetic field. The electrical signals representing the sound flow through the voice coil and interact with the magnetic field. This causes the voice coil and the coupled diaphragm to oscillate in response to the electrical signal. The oscillation of the diaphragm produces air pressure waves.

It is necessary for the audio speakers to displace a volume of air to produce sound pressure waves that are perceptible to a listener. A speaker diaphragm is limited in the distance it can move, and this limit become smaller as the speaker is reduced in size. This limits the volume of sound that can be produced by a small speaker, particularly in lower frequency range.

It would be desirable to provide an audio speaker that can displace a larger volume of air from a more compact structure suitable for use in portable devices.

SUMMARY

An acoustic transducer includes a housing, which may be a circular cylinder or may have a rectangular cross-section. Two permanent magnets that closely fit the inside of the housing are joined by a linkage having a high magnetic permeability to form a piston that is inserted into the housing. Two pole coils surround the housing with each coil adjacent one of the permanent magnets. The coils are arranged to cause the piston to oscillate within the housing and emit sound waves when coupled to an electrical signal. One end of the housing may be closed except for a barometric leak. A third permanent magnet or a spring may provide a restoring force that centers the piston between the coils when the piston is not subjected to other forces. One of the permanent magnets on the piston may include a vent passage.

Other features and advantages of the present invention will be apparent from the accompanying drawings and from the detailed description that follows below.

BRIEF DESCRIPTION OF THE DRAWINGS

The invention may best be understood by referring to the following description and accompanying drawings that are used to illustrate embodiments of the invention by way of example and not limitation. In the drawings, in which like reference numerals indicate similar elements.

DETAILED DESCRIPTION

In the following description, numerous specific details are set forth. However, it is understood that embodiments of the invention may be practiced without these specific details. In other instances, well-known circuits, structures and techniques have not been shown in detail in order not to obscure the understanding of this description. Explanations that duplicate one another may have been omitted.

The meaning of specific terms or words used in the specification and claims should not be limited to the literal or commonly employed sense, but may be different and should be construed in the context of the specification. The terms "first," "second," and the like, herein do not denote any order, quantity, or importance, but rather are used to distinguish one element from another. The terms "a" and "an" herein do not denote a limitation of quantity, but rather denote the presence of at least one of the referenced item.

Figure 1:
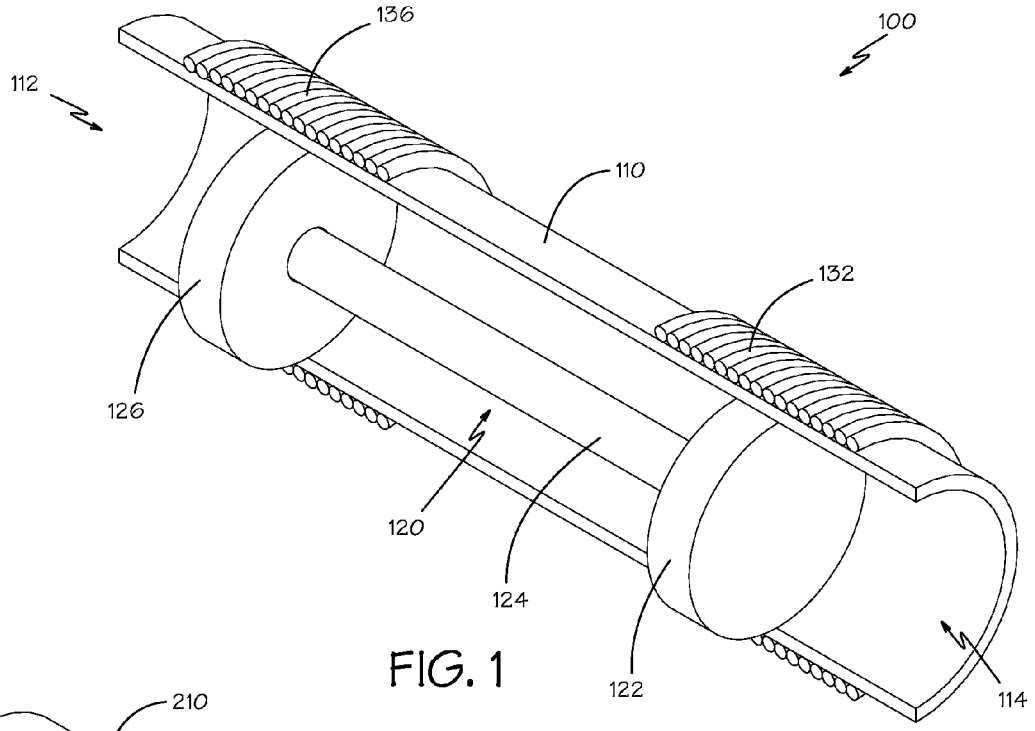
FIG. 1 is a pictorial view of an acoustic transducer with a front portion of a cylindrical housing cut away along a diameter.

FIG. 1 is a pictorial view of an acoustic transducer 100. The acoustic transducer shown includes a cylindrical housing 110 having a circular cross-section, which is shown with a front portion of the housing cut away along a diameter to allow the internal components to be seen.

The acoustic transducer 100 further includes a piston 120. A first permanent magnet 122 and a second permanent magnet 126 are coupled to a linkage 124 having a high magnetic permeability to form the piston 120. One of the permanent magnets provides a north magnetic pole for the piston structure 120 and the other permanent magnet provides a south magnetic pole. Each of the permanent magnets 122, 126 is closely fit to the inside of the housing 110. A ferromagnetic liquid may be used between the first and second permanent magnets 122, 126 and the housing 110 to provide lubrication and a seal between the magnets and the housing.

A first pole coil 132 surrounds the housing 110 adjacent the first permanent magnet 122 and a second pole coil 136 surrounds the housing adjacent the second permanent magnet 126. The pole coils 132, 136 are shown cut away along a diameter to allow the internal components to be seen. The first pole coil 132 and the second pole coil 136 are arranged to cause the piston 120 to oscillate within the housing 110 when the pole coils are coupled to an electrical signal. The two pole coils may be coupled to the electrical signal with a series or parallel connection.

Oscillations of the piston 120 at audible frequencies will cause an audible sound to be emitted from the two open ends 112, 114 of the housing 110. The pressure waves coming out of each of the two open ends 112, 114 will be out-of-phase and could cancel in far field. However, if the acoustic transducer 100 is situated such that one end 114 is opened to the exterior of a device casing and the other end 112 radiates into the inside of the device casing, essentially putting it in a wraparound baffle, the concern of phase cancellation can be mitigated.

Oscillations of the piston 120 at lower frequencies, perhaps between 100 HZ and 250 Hz or perhaps even into sub-audible ranges, may produce a sufficiently strong vibration that the acoustic transducer 100 can be used to produce a tactile alert. For example, in a cellular telephone application it may be possible to use the acoustic transducer 100 as both a speaker and an alerting vibrator. By configuring the subsystem that delivers the electrical signal to the acoustic transducer 100 to provide either a signal suitable to produce an audio output or a signal suitable to produce tactile alert, which may also result in an audible audio output, the acoustic transducer may selectively perform the functions of both an audio speaker and an alerting vibrator.

The separation of the first and second permanent magnets 122, 126 and the first pole coil 132 and the second pole coil 136 allows the piston 120 to achieve larger displacements with a lower piston mass than would be possible with a single permanent magnet and/or a single coil. This in turn allow a larger volume of air to be displaced by the piston 120 which creates a louder sound.

Figure 2:
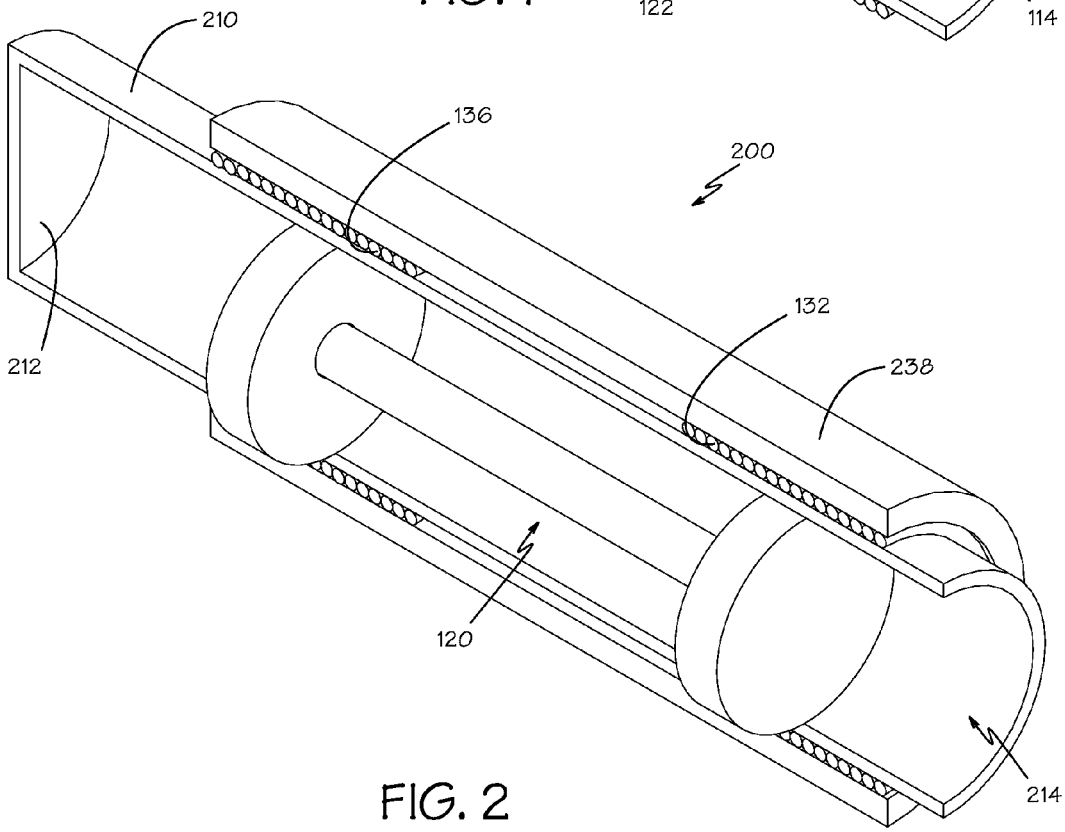
FIG. 2 is a pictorial view of another acoustic transducer with a front portion of a cylindrical housing cut away along a diameter.

FIG. 2 is a pictorial view of another acoustic transducer 200. The acoustic transducer shown includes a cylindrical housing 210 having a circular cross-section, which is shown with a front portion of the housing cut away along a diameter to allow the internal components to be seen. One end 212 of the housing 210 is closed. Sound will be emitted from the open end 214 of the housing 210. This prevents the emission of an out-of-phase pressure wave from the second, closed end 212 but the closed end may form an acoustic spring that dominates the effective mechanical stiffness of the piston 120.

In some embodiments one or more pole pieces 238 having a high magnetic permeability may be placed adjacent the first pole coil 132 and the second pole coil 136 to enhance the magnetic flux density in the vicinity of the coils. In FIG. 2 a single pole piece 238 is shown cut away along a diameter to allow the internal components to be seen.

Figure 3:
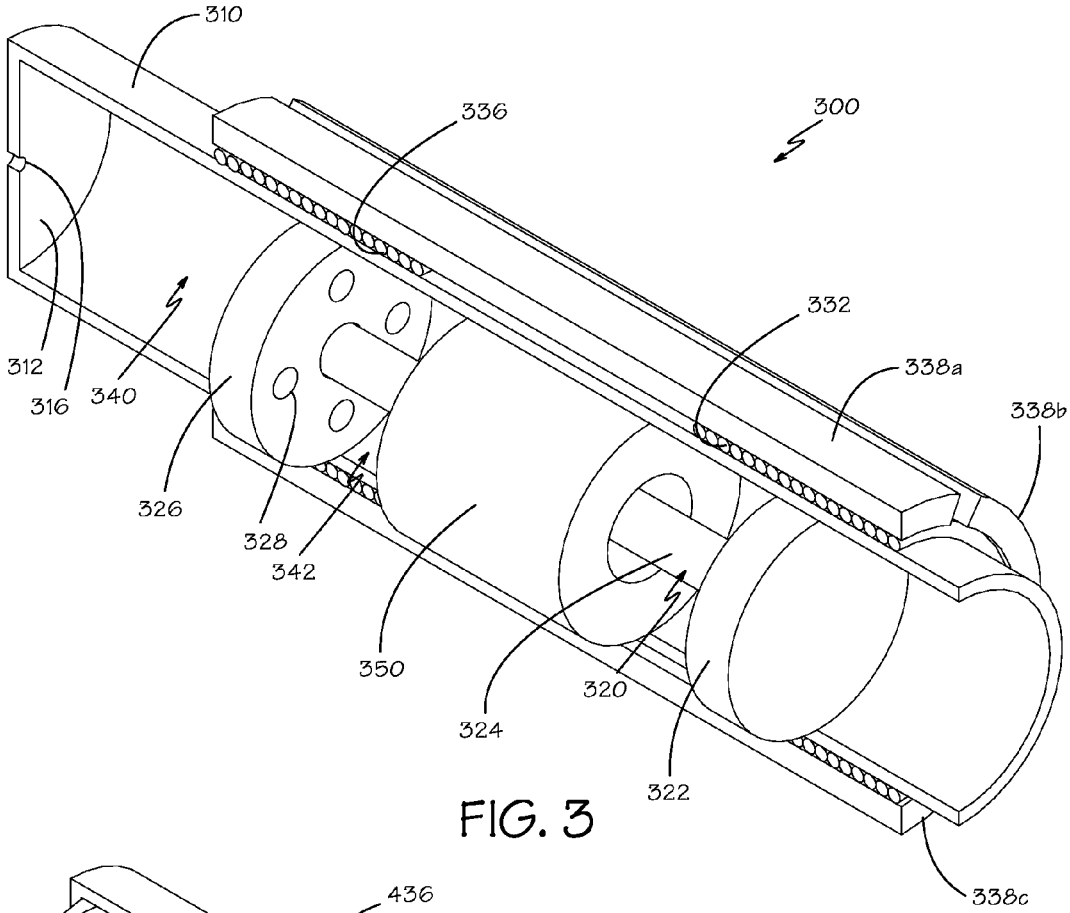
FIG. 3 is a pictorial view of still another acoustic transducer with a front portion of a cylindrical housing cut away along a diameter.

FIG. 3 is a pictorial view of still another acoustic transducer 300. The acoustic transducer shown includes a cylindrical housing 310 having a circular cross-section, which is shown with a front portion of the housing cut away along a diameter to allow the internal components to be seen. One end 312 of the housing 310 is closed. A small hole 316 is provided in the closed end to provide a barometric leak. The hole 316 is small enough that no appreciable amount of sound is emitted from the hole. However, changes in the ambient atmospheric pressure are transmitted through the small hole 316 so that the equilibrium of the piston 320 is not affected by the changes in atmospheric pressure.

In some embodiments the permanent magnet 326 adjacent the closed end 312 of the housing 310 includes one or more vent passages 328 to couple a space 342 between the first and second permanent magnets to a space 340 external to the piston. This increases the volume of the trapped air in the housing and reduces the stiffness of the acoustic spring formed by the closed end. The vent passages 328 may be arranged symmetrically to avoid creating unbalanced forces on the permanent magnet 326.

In some embodiments multiple pole pieces 338*a*, 338*b*, 338*c* may be formed from two or more pieces of material having a high magnetic permeability, with each piece extending between the two pole coils 332, 336. When multiple pole pieces are used, the pole pieces may or may not be contiguous around each of the coils. For example, FIG. 3 shows pole pieces 338*a*, 338*b*, 338*c* that are not contiguous around each of the coils 332, 336.

In some embodiments a third permanent magnet 350 is coupled to the inside of the housing 310 adjacent a midpoint of the linkage 324 that couples the first 322 and second 326 permanent magnets. The third permanent magnet 350 is arranged with its poles adjacent the like poles of the first 322 and second 326 permanent magnets. The third permanent magnet 350 thus repels both ends of the piston 320 and holds the piston at an equilibrium position when no power is applied to the two pole coils 332, 336.

Figure 4:
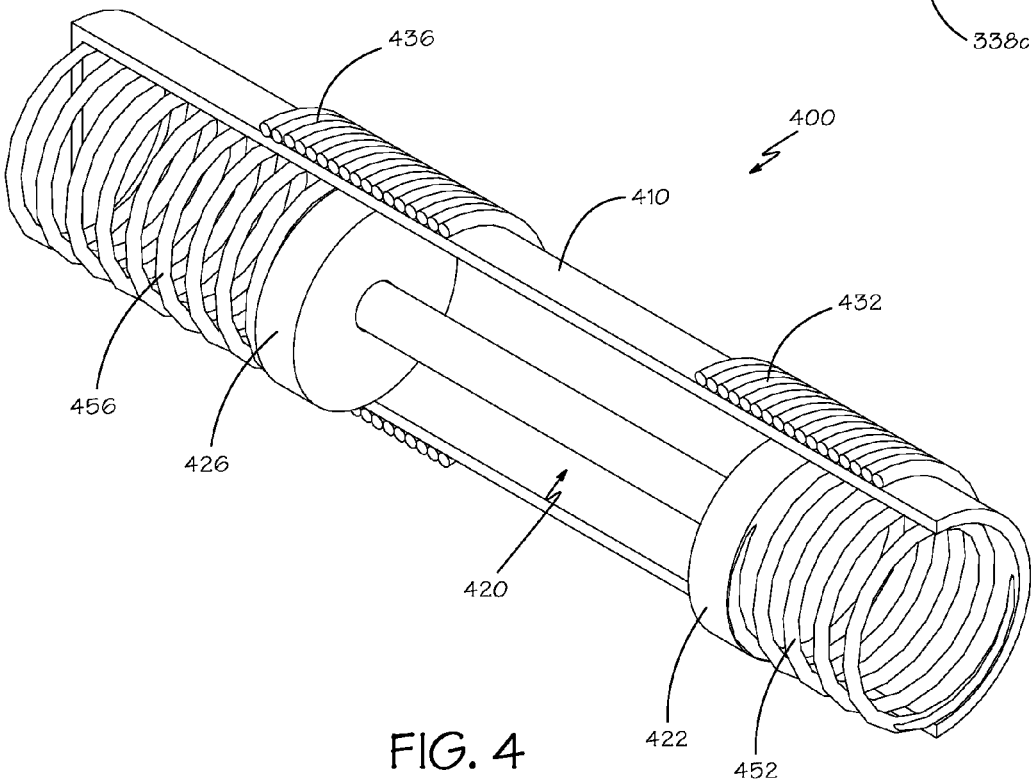
FIG. 4 is a pictorial view of yet another acoustic transducer with a front portion of a cylindrical housing cut away along a diameter.

FIG. 4 is a pictorial view of yet another acoustic transducer 400. The acoustic transducer shown includes a cylindrical housing 410 having a circular cross-section, which is shown with a front portion of the housing cut away along a diameter to allow the internal components to be seen. In some embodiments the acoustic transducer includes one or more springs coupled to the piston to provide a restoring force that moves the piston to substantially center the piston between the first and second pole coils when the piston is not subjected to any other forces such as the forces created by the pole coils when energized. For example, FIG. 4 shows an acoustic transducer 400 that includes two compression springs 452, 456 that bear against their respective permanent magnets 422, 426 at a first end of the spring and the housing 410 at a second end of the spring. The springs 452, 456 hold the piston 420 at an equilibrium position when no power is applied to the two pole coils 432, 436.

Figure 5:
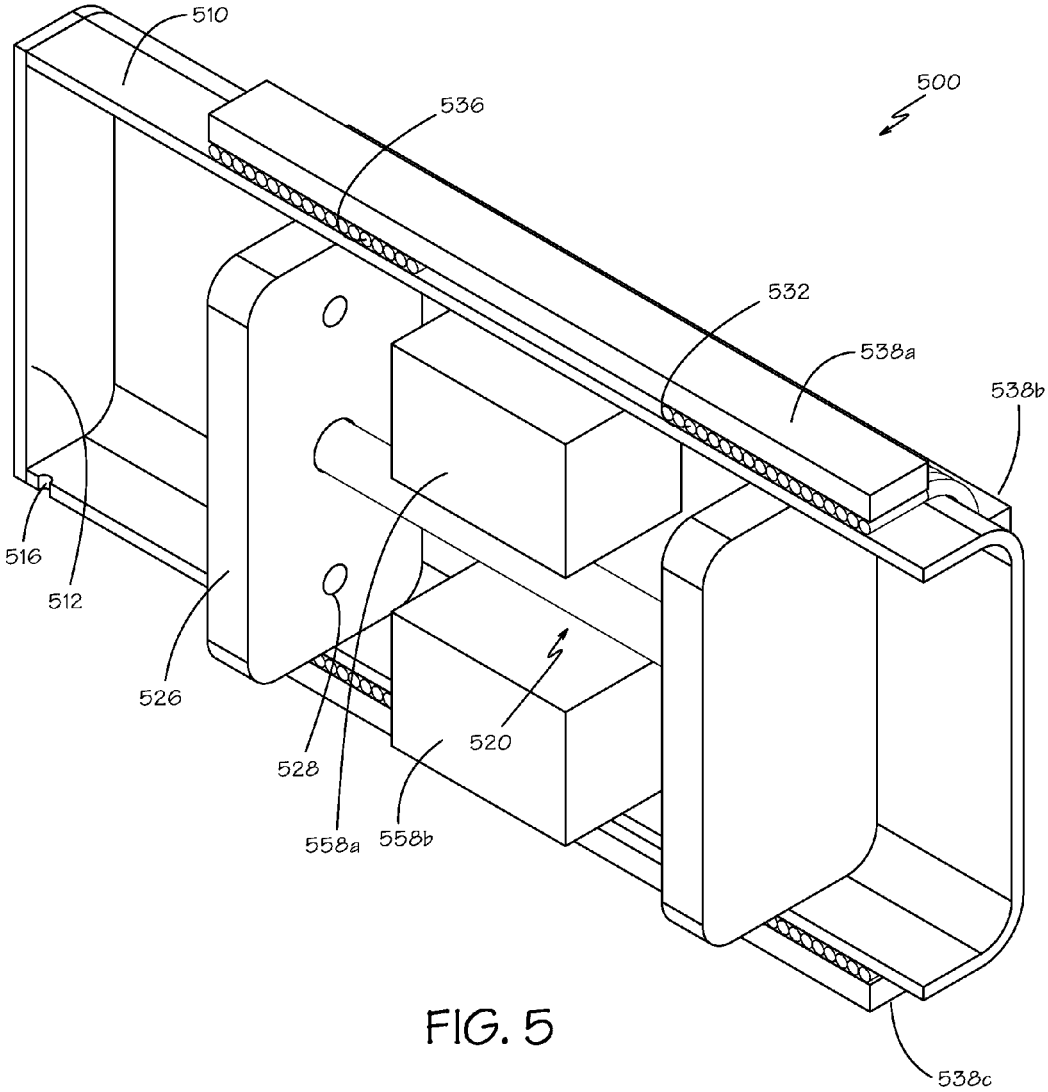
FIG. 5 is a pictorial view of another acoustic transducer with a front portion of a rectangular housing cut away.

FIG. 5 is a pictorial view of another acoustic transducer 500. The acoustic transducer shown includes a housing 510 having a substantially rectangular cross-section, which is shown with a front portion of the housing cut away to allow the internal components to be seen. In some embodiments the housing is a more generalized cylinder having a non-circular cross-section. For example, the acoustic transducer 500 shown in FIG. 5 has a housing that is a cylinder with a cross-section of a rectangle with filleted corners. The use of a rectangular cylinder 510 for the housing allows the acoustic transducer 500 to have a larger cross-section and thus, a larger volume of air displacement than a circular cylindrical housing with a diameter equal to the smaller side of the rectangle. This may be advantageous for acoustic transducers that are used in "thin" devices where the height of the acoustic transducer must be small to fit within the device. As shown, a polygonal cylinder may have rounded corners on the polygon.

The acoustic transducer 500 shown in FIG. 5 also includes features that have been previously described. High magnetic permeability pole pieces 538*a*, 538*b*, 538*c* that are not contiguous around each of the pole coils 532, 536 are placed adjacent the coils. A third permanent magnet, provided as two separate segments 550*a*, 558*b*, holds the piston 520 at an equilibrium position when no power is applied to the two pole coils 532, 536. The closed end 512 of the housing 510 includes a small hole 516 in the side wall of the housing to provide a barometric leak. The permanent magnet 526 adjacent the closed end 512 of the housing 510 includes two vent passages 528.

While certain exemplary embodiments have been described and shown in the accompanying drawings, it is to be understood that such embodiments are merely illustrative of and not restrictive on the broad invention, and that this invention is not limited to the specific constructions and arrangements shown and described, since various other modifications may occur to those of ordinary skill in the art. The description is thus to be regarded as illustrative instead of limiting.

What is claimed is:

1. An acoustic transducer comprising:

a housing;

a piston for displacing air in the housing to produce sound pressure waves, the piston including a linkage, a first permanent magnet closely fit to the inside of the housing and coupled to a first end of the linkage to provide a first magnetic pole, and a second permanent magnet closely fit to the inside of the housing and coupled to a second end of the linkage opposite the first end to provide a second magnetic pole;

a first pole coil surrounding the housing and the first permanent magnet;

a second pole coil surrounding the housing and the second permanent magnet; and a third permanent magnet coupled to the inside of the housing adjacent a midpoint of the linkage with poles of the third permanent magnet arranged to repel the first permanent magnet and the second permanent magnet;

wherein the first pole coil and the second pole coil are arranged to cause the piston to oscillate within the housing when coupled to an electrical signal.

2. The acoustic transducer of claim 1 wherein one end of the housing is closed except for a hole that provides a barometric leak.

3. The acoustic transducer of claim 1 further comprising at least one pole piece magnetically coupling the first pole coil and the second pole coil.

4. The acoustic transducer of claim 1 wherein one of the first and second permanent magnets includes a vent passage that couples a space between the first and second permanent magnets to a space external to the piston.

5. The acoustic transducer of claim 1 wherein the housing has a substantially rectangular cross-section.

6. A method for constructing an acoustic transducer, the method comprising:

assembling a piston by joining a first permanent magnet and a second permanent magnet to opposite ends of a linkage;

inserting the piston into a housing with the first permanent magnet and the second permanent magnet closely fit to the inside of the housing;

surrounding the housing and the first permanent magnet with a first pole coil;

surrounding the housing and the second permanent magnet with a second pole coil; and attaching a third permanent magnet to the inside of the housing adjacent a midpoint of the linkage with poles of the third permanent magnet arranged to repel the first permanent magnet and the second permanent magnet;

wherein the first pole coil and the second pole coil are arranged to cause the piston to oscillate and displace air within the housing to produce sound pressure waves when coupled to an electrical signal.

7. The method of claim 6 further comprising closing one end of the housing and providing a hole that creates a barometric leak.

8. The method of claim 6 further comprising magnetically coupling the first pole coil and the second pole coil with at least one pole piece.

9. The method of claim 6 further comprising providing a vent passage in at least one of the first and second permanent magnets to couple a space between the first and second permanent magnets to a space external to the piston.

10. The method of claim 6 wherein the housing has a substantially rectangular cross-section.

11. An acoustic transducer comprising:

a housing;

a first permanent magnet;

a second permanent magnet;

means for joining the first permanent magnet and the second permanent magnet to form a piston having opposite ends of different magnetic polarities;

means for causing the piston to oscillate and displace air within the housing to produce sound pressure waves when coupled to an electrical signal; and means for providing a restoring force that moves the piston to substantially center the piston between the first and second pole coils when the piston is not subjected to any other forces.

12. The acoustic transducer of claim 11 further comprising means for closing one end of the housing and providing a barometric leak in the closed end.

13. The acoustic transducer of claim 11 wherein the means for causing the piston to oscillate and displace air includes a first pole coil and a second pole coil, the acoustic transducer further comprising means for magnetically coupling the first pole coil and the second pole coil.

14. The acoustic transducer of claim 11 further comprising means for coupling a space between the first and second permanent magnets to a space external to the piston.

15. The acoustic transducer of claim 11 wherein the housing has a substantially rectangular cross-section.

16. The acoustic transducer of claim 1 wherein the close fit of the first permanent magnet and the second permanent magnet to the inside of the housing causes an audible sound to be emitted from the housing when the piston oscillates within the housing at an audible frequency.

17. The method of claim 6 wherein the close fit of the first permanent magnet and the second permanent magnet to the inside of the housing causes an audible sound to be emitted from the housing when the piston oscillates within the housing at an audible frequency.

18. The method of claim 6 further comprising closing one end of the housing and providing a small hole that creates a barometric leak.

19. An acoustic transducer comprising:

a housing;

a piston for displacing air in the housing to produce sound pressure waves, the piston including a linkage, a first permanent magnet closely fit to the inside of the housing and coupled to a first end of the linkage to provide a first magnetic pole, and a second permanent magnet closely fit to the inside of the housing and coupled to a second end of the linkage opposite the first end to provide a second magnetic pole;

a first pole coil surrounding the housing and the first permanent magnet;

a second pole coil surrounding the housing and the second permanent magnet; and a spring coupled to the piston to provide a restoring force that moves the piston to substantially center the piston between the first and second pole coils when the piston is not subjected to any other forces;

wherein the first pole coil and the second pole coil are arranged to cause the piston to oscillate within the housing when coupled to an electrical signal.

20. The acoustic transducer of claim 19 wherein one end of the housing is closed except for a hole that provides a barometric leak.

21. The acoustic transducer of claim 19 further comprising at least one pole piece magnetically coupling the first pole coil and the second pole coil.

22. The acoustic transducer of claim 19 wherein one of the first and second permanent magnets includes a vent passage that couples a space between the first and second permanent magnets to a space external to the piston.

23. The acoustic transducer of claim 19 wherein the housing has a substantially rectangular cross-section.

24. The acoustic transducer of claim 19 wherein the close fit of the first permanent magnet and the second permanent magnet to the inside of the housing causes an audible sound to be emitted from the housing when the piston oscillates within the housing at an audible frequency.

25. A method for constructing an acoustic transducer, the method comprising:

assembling a piston by joining a first permanent magnet and a second permanent magnet to opposite ends of a linkage;

inserting the piston into a housing with the first permanent magnet and the second permanent magnet closely fit to the inside of the housing;

surrounding the housing and the first permanent magnet with a first pole coil;

surrounding the housing and the second permanent magnet with a second pole coil; and coupling one or more springs to the piston to provide a restoring force that moves the piston to substantially center the piston between the first and second pole coils when the piston is not subjected to any other forces;

wherein the first pole coil and the second pole coil are arranged to cause the piston to oscillate and displace air within the housing to produce sound pressure waves when coupled to an electrical signal.

26. The method of claim 25 further comprising closing one end of the housing and providing a hole that creates a barometric leak.

27. The method of claim 25 further comprising magnetically coupling the first pole coil and the second pole coil with at least one pole piece.

28. The method of claim 25 further comprising providing a vent passage in at least one of the first and second permanent magnets to couple a space between the first and second permanent magnets to a space external to the piston.

29. The method of claim 25 wherein the housing has a substantially rectangular cross-section.

30. The method of claim 25 wherein the close fit of the first permanent magnet and the second permanent magnet to the inside of the housing causes an audible sound to be emitted from the housing when the piston oscillates within the housing at an audible frequency.

31. The method of claim 25 further comprising closing one end of the housing and providing a small hole that creates a barometric leak.

* * * * *